US006006889A

United States Patent [19]

Caron

[11] Patent Number: 6,006,889

[45] Date of Patent: Dec. 28, 1999

[54] DEVICE FOR DETERRING UNSAFE USAGE OF A HANDRAIL

[76] Inventor: Jean Marc Caron, 1616 Chopin, Laval Quebec, Canada, H7M 2E6

[21] Appl. No.: 09/094,718

[22] Filed: Jun. 15, 1998

Related U.S. Application Data

[60] Provisional application No. 60/049,505, Jun. 13, 1997.

[51] Int. Cl.[6] ..... B66B 23/22

[52] U.S. Cl. ..... 198/335; 198/338

[58] Field of Search ..... 198/321, 335, 198/337, 338

[56] References Cited

U.S. PATENT DOCUMENTS 2,578,566 12/1951 Masek et al. ..... 198/337

5,156,252 10/1992 Mello et al. ..... 198/338

5,332,078 7/1994 Johson et al. ..... 198/338

*Primary Examiner*—Joseph E. Valenza

[57] ABSTRACT

A deterring device for deterring unsafe usage of a handrail part of an escalator or other conventional people moving devices. The deterring device includes an elongated body positioned in an overlying yet space relationship relative to the handrail. The body define an overriding surface having a generally concave shaped configuration for allowing intended users to grasp the handrail while blocking access to the handrail by other body parts of the intended users and blocking access to the handrail from the exterior of the people moving device.

15 Claims, 3 Drawing Sheets

DEVICE FOR DETERRING UNSAFE USAGE OF A HANDRAIL

This appln. claims benefit for Provisional appln. No. 60/049,505 filed Jun. 13, 1997.

FIELD OF THE INVENTION

The present invention relates to the field of handrails for escalators or the like and is particularly concerned with a device for deterring unsafe use of the handrail.

BACKGROUND OF THE INVENTION

Passenger moving devices such as escalators, moving walkways, horizontal passenger conveyors and the like are used extensively in various locations including most commercial and public buildings. Such people moving devices typically include steps, belts or pallets that are mechanically driven at a relatively constant speed by a suitable mechanism.

Since passengers using such passenger moving devices must step unto a moving object, at least one handrail in the form of a strip of material traveling in the same direction and at the same speed as the steps is usually provided for helping the passengers maintain their balance. Typically a handrail is positioned on each side of the step, the handrail being mounted on a corresponding balustrade assembly.

Each balustrade typically includes balustrade panels extending from the base to support the handrail. Externally, the base includes a number of enclosure panels having an outer decking, an outer cladding, an inner profile and a skirt panel. The outer decking and outer cladding enclose the mechanics on the side of the balustrade panel opposite the moving steps. The inner profile and skirt panel enclose the mechanics adjacent the moving steps.

As mentioned previously, the handrails are provided for allowing intended passengers to maintain balance while being transported by the moving steps. Although efficient for their intended purpose, they are sometimes used inappropriately by some individuals as a sliding or riding ramp. Indeed, some individuals, typically young adolescents, sit on the inclined handrail with their legs hanging adjacent the corresponding balustrade and slide down the handrail while attempting to maintain their balance. Obviously, this type of practice can lead to serious injury if a given individual falls-off the handrail and falls on either side of the balustrade.

Since the handrails are often inclined any individual sliding down the ladder may travel at a relatively high speed and, hence, may become injured or may even injure adjacent individuals as speed is picked up during the sliding action. The risk of injury is sometimes compounded by the fact that escalators are commonly used to communicate between adjacent floors and, hence, any individual fling from the handrail opposite the moving treadway formed by the escalator may fall from a relatively important height. Furthermore, the practice of sliding down handrails is not only potentially dangerous to the individual performing the sliding action but is also detrimental to the escalator equipment leading to costly breakdowns.

Another problem encountered with conventional escalator construction relates to the fact that, as mentioned previously, the upper segment of the escalator is often located at a relatively important height relative to the ground surface. Consequently, any object dropped on the outer side of the balustrade opposite the moving treadway may drop onto individuals located underneath again potentially causing injury. A still further problem encountered with conventional escalator handrails relates to the fact that one might catch a sleeve, scarf or the like between moving handrail and its stationary guide.

Accordingly, there exists a need for a device increasing the overall safety of conventional handrails. Advantages of the present invention include the fact that this device deters unsafe use of handrails such as riding or sliding down the handrail in a sitting or other position while allowing the handrail to be used for its intended balancing aid purpose.

The proposed invention also provides a shield for retaining objects being dropped on the outer side of the balustrade and preventing such objects from potentially injuring individuals located underneath.

Furthermore, the proposed invention is adapted to reduce the risk of an individual catching a scarf a sleeve or the like between the moving guiding rail and its associated stationary guide.

Also, the proposed invention is specifically designed so as to be easily mounted on most conventional handrail constructions.

Furthermore, the proposed invention is specifically configured so as to be both safe and esthetically pleasing.

Also, the proposed invention is designed so as to be manufactured using conventional forms of manufacturing thus providing a device that is economically feasible.

In accordance with one aspect of the invention there is provided a deterring device for deterring unsafe usage of a handrail, the handrail being mounted on a handrail guide extending from an upper peripheral edge part of a balustrade, the balustrade dining a balustrade inner side and a balustrade outer side, the balustrade having longitudinally opposed newell end sections, the handrail having a transverse dimension defining a handrail inner side edge and an opposed handrail outer side edge, the handrail also having a thickness defining a handrail top surface and an opposed handrail bottom surface, the deterring device comprising a generally elongated body, the body defining a generally concave-shaped overriding surface, the overriding surface being positioned in an overriding yet spaced relationship relative to the handrail so as to allow grasping of the handrail by an intended user positioned on the balustrade inner side while blocking access to the handrail from the balustrade outer side, the deterring device also comprising a supporting means for supporting the elongated body in the overriding yet spaced relationship relative to the handrail, the body being fixedly attached to a supporting means first end, the supporting means having a supporting means second end rigidly attached to a structure other than the handrail but positioned relatively adjacent to the latter.

Preferably, the overriding surface defines a first segment overriding a portion of the handrail top surface adjacent the handrail outer side edge, the first segment defining a distal free hand, the first segment extending outwardly from the distal free hand, the overriding surface also defining a second segment extending from the first segment in a generally downward direction so as to overlie the handrail outer side edge; the overriding surface further defining a third segment extending from the second segment toward the balustrade.

Typically, the elongated body is spaced from the handrail by a spacing distance substantially in the range between 1" and 48". Preferably, the body is formed of a relatively thin sheet of material integrally bent so as to define the overriding surface, the sheet of material defining a sheet peripheral edge. Typically, the sheet of material is bent so as to define a generally "C"-shaped cross sectional configuration. Conveniently, the sheet peripheral edge is inwardly bent about the free hand so as to define a relatively smooth edge.

Preferably, each of the body longitudinal ends is slanted towards a midsection of the body in a direction leading from the third segment to the first segment Conveniently, the supporting means includes a supporting segment extending from the third segment, the supporting segment being configured and sized to abuttingly contact the balustrade adjacent the handrail, the supporting means further including a fixing means for fixing the supporting segment to the balustrade.

Conveniently, the balustrade has a balustrade flange extending substantially perpendicularly and outwardly from the balustrade upper peripheral edge, the supporting segment having a generally "V"-shaped cross-sectional configuration defining a fourth and a fifth segment, the fourth segment being configured and sized for abutment against the balustrade adjacent the balustrade upper peripheral edge and the fifth segment being configured and sized for abutment against the balustrade flange.

In an alternative embodiment, the supporting means includes an abutment leg extending from the body, the abutment leg being configured and sized for abutment against a structure part of the environment adjacent the handrail.

In accordance with another aspect of the invention there is provided a people moving device comprising: a treadway; a balustrade flanking the treadway; a handrail guide mounted on an upper peripheral edge of the balustrade; a handrail mounted on the handrail guide for use by passengers standing on the treadway, an elongated body having a generally concave overlying surface positioned so as to overlie a portion of the handrail, the elongated body being positioned so as to allow the passenger standing on the treadway to grasp the handrail while obstructing access to the handrail from passengers outside of the treadway and preventing the handrail from being used as a riding or sliding ramp.

Preferably, the overriding surface defines a first segment overriding #a portion of the handrail top surface adjacent the handrail outer side edge, the first segment defining a distal free hand, the first segment extending outwardly from the distal free hand; the overriding surface also defining a second segment extending from the first segment in a generally downward direction so as to overlie the handrail outer side edge; the overriding surface flyer defining a third segment extending from the second segment toward the balustrade.

In accordance with yet another aspect of the invention there is provided a method for deterring the usage of a handrail part of an escalator from being used as a riding or sliding ramp, the method comprising the step of positioning and maintaining an elongated body in an overlying yet spaced relationship relative to the handrail so as to allow grasping of the handrail by passengers while blocking access to the handrail by other body parts of the passengers.

BRIEF DESCRIPTION OF THE DRAWINGS

Various embodiments of the present invention will now be described, by way of example, in reference to the following drawings in which.

DETAILED DESCRIPTION OF THE DRAWINGS

Figure 1:
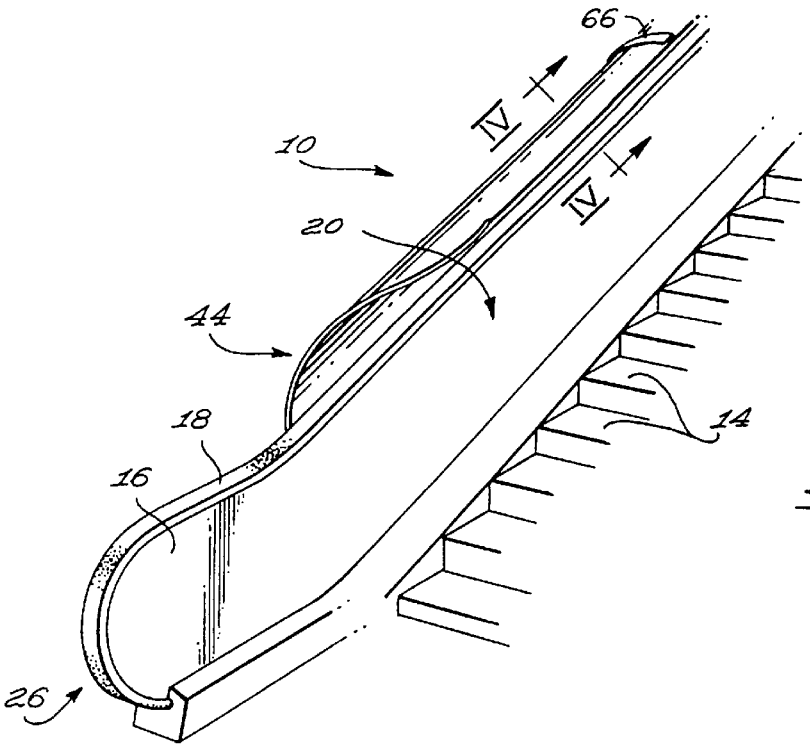
FIG. 1, in a partial perspective view with sections taken out, illustrates a deterring device in accordance with an embodiment of the present invention mounted adjacent the handrail of a conventional escalator.

Referring to FIG. 1, there is shown a device 10 in accordance with an embodiment of the present invention mounted on conventional escalator 12. It should be understood that although device 10 is shown in FIGS. 1 through 9 as being mounted to a conventional escalator, it could be used in a different context. For example, it could be mounted on other people moving devices such as moving walkways without departing from the scope of the present invention.

In FIG. 1, the escalator 12 is shown having a moving treadway in the form of moving steps 14. A relatively thin balustrade 16 flanks the treadway on both sides of the latter. A moving handrail 18 is mounted on each balustrade 16.

Figure 2:
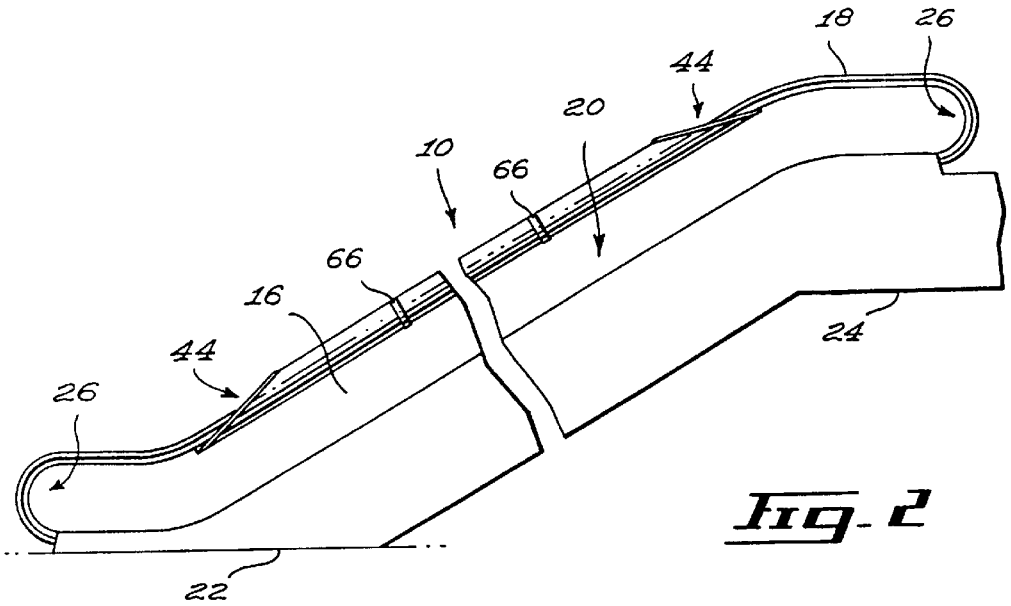
FIG. 2, in a side view with sections taken out, illustrates the device of FIG. 1 mounted on a conventional escalator.
Figure 3:
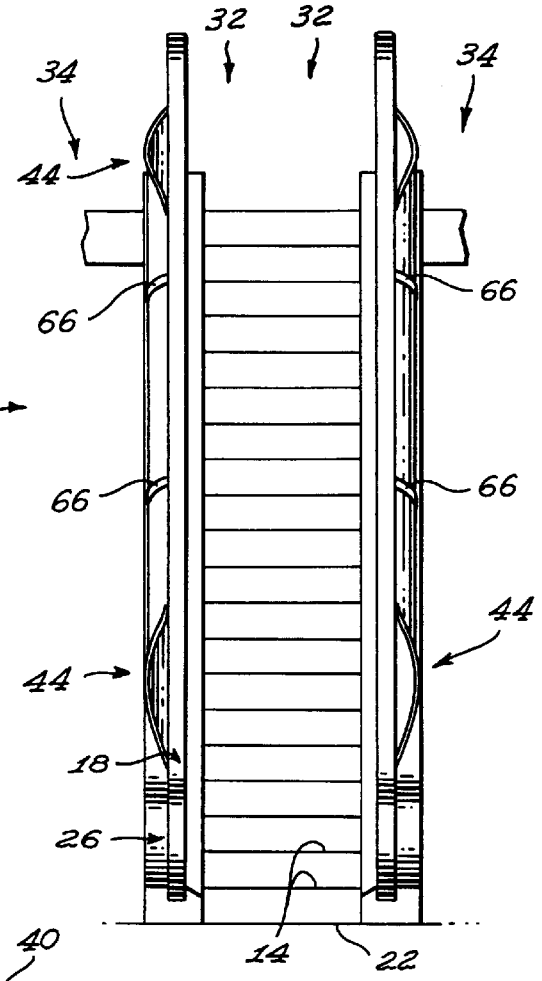
FIG. 3, in an elevational view, illustrates a pair of devices in accordance with the present invention mounted adjacent both handrails part of a conventional escalator.

As illustrated more specifically in FIG. 2, each balustrade 16 defines a balustrade central section 20 extending between a first ground surface 22 and a second ground surface 24 at an angle with the latter.

Each balustrade 16 further defines a pair of longitudinally opposed newell end sections 26 extending in a generally parallel relationship with the corresponding adjacent ground surfaces 22 and 24.

Figure 4:
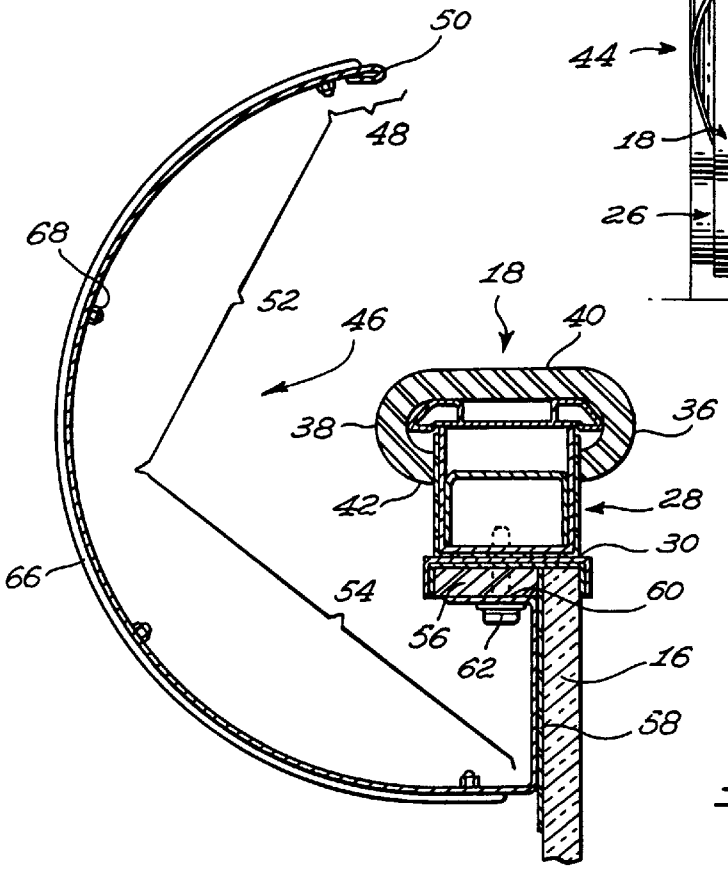
FIG. 4, in a cross sectional view taken along arrows 44 of FIG. 1, illustrates the device of FIG. 1 mounted on the balustrade assembly of the escalator also shown in FIG. 1.
Figure 5:
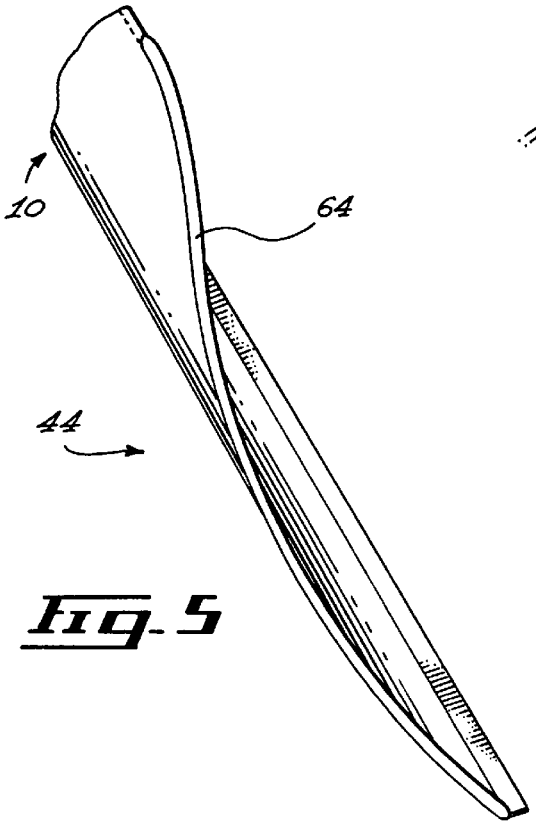
FIG. 5, in a partial perspective view with sections taken out, illustrates a longitudinal hand section of a device in accordance with an embodiment of the present invention such as the one shown in FIG. 1.
Figure 6:
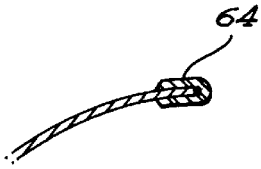
FIG. 6, in a detailed cross sectional view with sections taken out, illustrates the distal edge of a device in accordance with an embodiment of the present invention.

As shown in greater details in FIG. 4, the handrail 18 typically has a generally "C"-shaped cross sectional configuration. The handrail 18 is typically slidebly mounted on a corresponding handrail guide 28. The handrail guide 28, in turn, is mounted on an upper peripheral edge 30 of the balustrade 16.

The balustrade 16 separates a balustrade inner side 32 from a balustrade outer side 34. The moving treadway is located on the inner side 32 of each balustrade 16. The handrail 18 has a transverse dimension defining a handrail inner side edge 36 and an opposed handrail outer side edge 38. The handrail 18 also has a handrail thickness defining a handrail top surface 40 and an opposed handrail bottom surface 42.

Referring back to FIG. 2, the device 10 is shown having a generally elongated body defining a pair of opposed body longitudinal ends 44. As illustrated more specifically in FIG. 4, the device 10 defines a generally concave-shaped overriding surface 46 for overriding partially a portion of the handrail 18. The overriding surface 46 defines a first segment 48 overriding a portion of the handrail top surface 40 adjacent the handrail outer side edge 38. The first segment 48 has a distal free hand 50. The first segment 48 extends generally outwardly from the distal free hand 50.

The overriding surface 46 defines a second segment 52 extending from the first segment 48 in a generally downward direction so as to overlie the handrail outer side edge 38. The overriding surface 46 further defines a third segment 54 extending from the second segment 52 towards the balustrade 16. The overriding surface 46 is thus configured so as to override the handrail outer side edge 38 and a portion of the handrail top surface 40. The overriding surface 46 is maintained in a spaced relationship relative to the handrail 18 so as to allow an intended user positioned in the treadway to grasp the handrail 18. Typically, the overriding surface 46 is spaced from the handrail 18 by a distance substantially in the range of between 1 and 48 inches.

Although allowing grasping of the handrail by a user positioned in the treadway, the body of the device 10 is positioned so as to block access to the handrail 18 from the balustrade outer side 34 and also to deter access to the handrail 18 by other body parts so as to prevent the handrail 18 from being used as a riding or sliding ramp. Indeed, the first segment 48 overriding the handrail top surface 40 deters individual from sitting on the handrail 18.

The overriding surface 48 also provides a retaining shield for retaining objects such as keys, coins or the like which may slip from the hand of an intended user grasping the handrail 18 adjacent the second floor 24. The device 10 thus further acts as a means from preventing objects from falling onto individuals standing underneath or adjacent the escalator 12.

The device 10 also includes a supporting means for supporting the body of the device so that the overriding surface 46 is in a generally proximate yet spaced relationship relative to the handrail 18. The body is fixedly attached to a supporting means first end. The supporting means also has a supporting means second end rigidly attached to a structure other than the handrail 18 but positioned relatively adjacent to the latter.

In the embodiment illustrated in FIG. 4, the balustrade 16 has a balustrade flange 58 extending substantially perpendicularly and outwardly from its upper peripheral edge 30. The fixing means includes a generally "L"-shaped fixing bracket defining a fourth segment 58 extending from a distal end of the third segment 54. The fourth segment 58 is configured and sized for abuttingly contacting an upper section of the balustrade 16. The "L"-shaped bracket further defines a fifth segment 60 extending substantially perpendicularly and outwardly from the fourth segment 58. The fifth segment 60 is configured and sized so as to abuttingly contact a lower surface of the balustrade flange 56. A conventional fixing means such as a bolt type component 62 extending through the fifth segment 60 and the balustrade flange 56 is provided for securing the "L"-shaped bracket to the balustrade 16.

In a preferred embodiment of the invention, the body of the device 10 is formed of a relatively thin sheet of material integrally bent so as to define the overriding surface 46. The sheet of material defines a sheet peripheral edge. Preferably, the sheet of material is bent so as to define a generally "C"-shaped cross sectional configuration.

In order to prevent the body of the device 10 from forming relatively sharp edges which may potentially cause injury the peripheral edge of the sheet of material is preferably inwardly bent at the first segment distal free hand 50. For the same reason, as illustrated more specifically in FIG. 2, the body longitudinal edges of the device 10 have a generally inwardly beveled configuration such that each body longitudinal end is slanted toward a mid-section of the body in a direction leading from the third segment 54 to the first segment 48. Furthermore, the peripheral edges of the body longitudinal ends may be covered with a protective cap 64 shown more particularly in FIGS. 5 and 6. The protective cap 64 is typically made of a relatively resilient material such as a strip of elastomeric material.

The body of the device 10 may be formed out of more then one piece of material assembled together using correspondingly shaped assembly brackets 66. A set of assembly nut and bolt components 68 extends through both the assembly bracket 66 and the adjacent sheets of material so as to form a generally longitudinally continuous body. The assembly brackets 66 further act as reinforcing ribs for increasing the overall rigidity of the body despite its relative lightweight.

Figure 7:
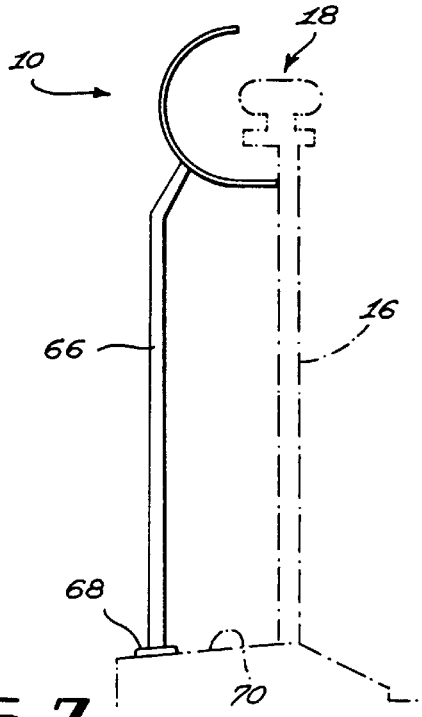
FIG. 7, in an elevational view with sections taken out, illustrates a device in accordance with a second embodiment of the present invention mounted adjacent a conventional handrail, the handrail being shown in phantom lines.
Figure 8:
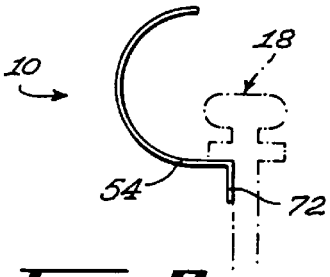
FIG. 8, in an elevational view with sections taken out, illustrates a device in accordance with a third embodiment of the present invention mounted adjacent a conventional handrail, the handrail being shown in phantom lines.
Figure 9:
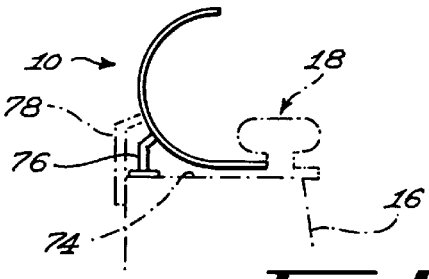
FIG. 9, in an elevational view with sections taken out, illustrates a device in accordance with a fourth embodiment of the present invention mounted adjacent a conventional handrail, the handrail being shown in phantom lines.

FIGS. 7 through 9 illustrate alternative embodiments of the invention wherein various supporting means configurations are used. It should be understood that the embodiments shown in FIGS. 7 through 9 constitute examples of variations of the supporting means and that other supporting means could be used without departing from the scope of the present invention.

In the embodiment illustrated in FIG. 7, the supporting means includes a supporting leg 66 fixedly attached at a first hand thereof to the body of the device 10 preferably adjacent the third segment 54 and having a base plate 68 at the opposed end abuttingly resting against the ground surface 70 adjacent the balustrade 16. In the embodiment illustrated in FIG. 8, the body further defines an abutment segment 72 extending integrally substantially perpendicularly and downwardly from the body of the device 10 adjacent the third segment 54. The abutment segment 72 is configured and sized so as to abut against the outer surface of the balustrade 16. Conventional fixing means such as bolts, adhesive material or the like may be used to secure abutment segment 72 to the balustrade 16. In the embodiment illustrated in FIG. 9, the balustrade 16 extends outwardly relative to the handrail outer surface 38 and thus defines a balustrade upper surface 74. The supporting means includes an abutment leg 76 extending between the body of the device 10 and the balustrade top surface 74. An optional stabilizing leg 78 also extending from the body of the device 10 may be used for abutting against the outer surface of the balustrade 16 and thus further stabilizing the device 10.

The embodiments of the invention in which an exclusive privilege or property is claimed are defined as follows:

1. A deterring device for deterring unsafe usage of a handrail said handrail being mounted on a handrail guide extending from an upper peripheral edge part of a balustrade, said balustrade defining a balustrade inner side and a balustrade outer side, said balustrade having longitudinally opposed newell end sections, said handrail having a transverse dimension defining a handrail inner side edge and an opposed handrail outer side edge, said handrail also having a thickness defining a handrail top surface and an opposed handrail bottom surface, said deterring device comprising:

a generally elongated body, said body defining a generally concave-shaped overriding surface, said overriding surface being positioned in an overriding yet spaced relationship relative to said handrail so as to allow grasping of said handrail by an intended user positioned on said balustrade inner side while blocking access to said handrail from said balustrade outer side, said deterring device also comprising a supporting means for supporting said elongated body in said overriding yet spaced relationship relative to said handrail, said body being fixedly attached to a supporting means first end, said supporting means having a supporting means second end rigidly attached to a structure other than said handrail but positioned relatively adjacent to the latter.

2. A deterring device as recited in claim 1 wherein said overriding surface defines a first segment overriding a portion of said handrail top surface adjacent said handrail outer side edge, said first segment defining a distal free hand, said first segment extending outwardly from said distal free hand; said overriding surface also defining a second segment extending from said first segment in a generally downward direction so as to overlie said handrail outer side edge;

said overriding surface further defining a third segment extending from said second segment toward said balustrade.

3. A deterring device as recited in claim 1 wherein said elongated body is spaced from said handrail by a spacing distance substantially in the range between 1" and 48".

4. A deterring device as recited in claim 1 wherein said body is formed of a relatively thin sheet of material integrally bent so as to define said overriding surface, said sheet of material defining a sheet peripheral edge.

5. A deterring device as recited in claim 4 wherein said sheet of material is bent so as to define a generally "C"-shaped cross sectional configuration.

6. A deterring device as recited in claim 4 wherein said sheet peripheral edge is inwardly bent about said free hand so as to define a relatively smooth edge.

7. A deterring device as recited in claim 2 wherein each of said body longitudinal ends is slanted towards a midsection of said body in a direction leading from said third segment to said first segment.

8. A deterring device as recited in claim 1 wherein said supporting means includes a supporting segment extending from said third segment, said supporting segment being configured and sized to abuttingly contact said balustrade adjacent said handrail, said supporting means further including a fixing means for fixing said supporting segment to said balustrade.

9. A deterring device as recited in claim 8 wherein said balustrade has a balustrade flange extend substantially perpendicularly and outwardly from said balustrade upper peripheral edge, said supporting segment having a generally "L"-shaped cross-sectional configuration defining a fourth and a fifth segment, said fourth segment being configured and sized for abutment against said balustrade adjacent said balustrade upper peripheral edge and said fifth segment being configured and sized for abutment against said balustrade flange.

10. A deterring device as recited in claim 1 wherein said supporting means includes an abutment leg extending from said body, said abutment leg being configured and sized for abutment against a structure part of the environment adjacent said handrail.

11. A deterring device as recited in claim 4 farther comprising a protective cap mounted on said sheet peripheral edge, said protective cap being made of a substantially resilient material and having rounded edges.

12. A deterring device as recited in claim 1 wherein said body is made of at least two sheets of material positioned in side by side relationship relative to one another, said sheets of material being assembled by corresponding assembly ribs.

13. A people moving device comprising:

a treadway, a balustrade flanking said treadway;

a handrail guide mounted on an upper peripheral edge of said balustrade;

a handrail mounted on said handrail guide for use by passengers standing on said treadway, an elongated body having a generally concave overlying surface positioned so as to overlie a portion of said handrail, said elongated body being positioned so as to allow said passenger standing on said treadway to grasp said handrail while obstructing access to said handrail from passengers outside of said treadway and preventing said handrail from being used as a riding or sliding ramp.

14. A people moving device as recited in claim 13 wherein said overriding surface defines a fist segment overriding a portion of said handrail top surface adjacent said handrail outer side edge, said first segment defining a distal free hand, said first segment extending outwardly from said distal free hand; said overriding surface also defining a second segment extending from said firs segment in a generally downward direction so as to overlie said handrail outer side edge;

said overriding surface further defining a third segment extending from said second segment toward said balustrade.

15. A method for deterring the usage of a handrail part of an escalator from being used as a riding or sliding ramp, said method comprising the step of positioning and maintaining an elongated body in an overlying yet spaced relationship relative to said handrail so as to allow grasping of said handrail by passengers while blocking access to said handrail by other body parts of said passengers.

* * * * *